United States Patent [19]

Cuthbert et al.

[11] 4,066,184

[45] Jan. 3, 1978

[54] THERMAL INSULATION SYSTEMS

[75] Inventors: William Livingstone Cuthbert; Thomas Brown, both of Mount Laurel, N.J.

[73] Assignee: Conch L.N.G., Moorestown, N.J.

[21] Appl. No.: 704,987

[22] Filed: July 13, 1976

[51] Int. Cl.[2] ..... B65D 87/24; B63B 25/16

[52] U.S. Cl. ..... 220/9 LG; 114/74 A; 220/15

[58] Field of Search ..... 220/5 A, 9 LG, 15, 63 R; 52/249, 406; 114/74 A

[56] References Cited

U.S. PATENT DOCUMENTS

| | | | |
|---|---|---|---|
| 3,112,043 | 11/1963 | Tucker | 220/15 X |
| 3,339,778 | 9/1967 | Herrenschmidt | 220/15 X |
| 3,401,816 | 9/1968 | Witt | 220/15 |
| 3,403,651 | 10/1968 | Gilles | 220/9 LG X |
| 3,517,850 | 6/1970 | Saldern et al. | 220/9 LG |
| 3,730,375 | 5/1973 | Reed et al. | 220/15 X |
| 3,773,604 | 11/1973 | Desai et al | 220/9 LG |
| 3,785,320 | 1/1974 | Bourgeois et al. | 220/9 LG X |
| 3,896,961 | 7/1975 | Guilhem et al. | 220/9 LG |
| 3,990,382 | 11/1967 | Lootvoet et al. | 220/15 X |

FOREIGN PATENT DOCUMENTS

| | | | |
|---|---|---|---|
| 477,337 | 10/1969 | Switzerland | 220/15 |

*Primary Examiner*—Stephen Marcus
*Attorney, Agent, or Firm*—Schiller & Pandiscio

[57] ABSTRACT

This invention relates to containers for the bulk storage or transport of liquefied gases, for example, in ocean going marine tankers comprising a tank surrounded and supported at least from below by thermal insulation built up from panels sealed together and supported by an outer rigid shell.

In such containers there is a problem of mounting the panels on said rigid shell so that they are rigidly fixed and aligned with each other. The invention is characterized by the provision of upstanding studs rigidly fixed to the rigid shell in spaced relationship determined by the shape and size of said panels, a fitting defining a seat mounted for axial movement on each stud, locking means for locking the fitting in an axially adjusted position, each edge of each panel defining an extended lip portion so that said panels can be supported in edge-to-edge relationship with said lip portions thereof located on the seats defined by said fittings, which fittings have been individually adjusted to provide a level supporting surface for the panels spaced from said outer shell first sealing means for sealing the outer faces of said panels, filling means for spaces between panel edges, and second sealing means for sealing the inner faces of said panels.

8 Claims, 5 Drawing Figures

THERMAL INSULATION SYSTEMS

This invention relates to containers for the bulk storage or transport of liquids at temperatures greatly differing from ambient temperature. The invention is primarily intended for cold liquids, such as liquefied gases, for example, natural gas.

Such containers are used, for example, in ocean going marine tankers and comprise a tank surrounded and supportd at least from below by thermal insulation within an outer rigid shell. Containers are known of various types including (i) a self-supporting tank supported solely on the bottom insulation, (ii) a self-standing tank where the bottom and sides of the tank are supported by the insulation, and (iii) the so-called integrated tank container comprising a housing of thermal insulation lined with a thin and flexible membrane tank of welded sheets of suitable material.

The thermal insulation for these various types of container may be of any appropriate material capable of carrying the loads imposed upon it. It is usually required to be fluid tight and impermeable to the liquid so as to constitute a secondary barrier i.e. a barrier additional to the tank which will itself contain a liquid. This is of particular relevance to marine tankers to reduce to an absolute minimum, the risk of e.g., liquefied natural gas at a temperature of approximately - 160° C, contacting the hull of the tanker with potential disastrous consequences due to cold embrittlement. A number of thermal insulation materials and constructions are known including the use of panels of balsa wood faced with plywood and sealed together along their edges (see U.S. Pat. No. 3,140,515), or sprayed layers of polyurethane foam (see U.S. Pat. No. 3,595,424). Also, use has been made of panels of pre-foamed polyurethane reinforced with a paper honeycombe matrix, the panels being suitably attached to the outer rigid shell (see U.S. Pat. No. 3,150,793).

An object of the invention is to provide for adequate sealing between the panels to enable the thermal insulation to provide a secondary barrier to the liquid.

Another problem resides in the fixing of the panels to the outer rigid shell, which is normally formed from a multiplicity of panel sheets welded together. Thus, the surface of said shell is generally not completely flat, due to small misalignments between the welded panel sheets, distortion etc and, therefore, in assembling the panels onto the hull it is first necessary to provide a level supporting surface spaced from the inner surface of the shell. This is normally achieved by the use of wooden grounds rigidly fixed at spaced positions over said inner surface of the shell (see U.S. Pat. No. 3,595,424) and it will be appreciated that such an arrangement is labour intensive.

It is another object of this invention to provide an alternative arrangement for said level supporting surface for the panels in which the spacing can be readily adjusted during fitting of the panels.

According to this invention, a container for the bulk storage and transport of liquids at temperatures greatly differing from ambient temperature, comprising a liquid storage tank surrounded and supported at least from below by thermal insulation which is built up from a multiplicity of panels sealed together and supported by a rigid outer shell, is characterized by upstanding studs rigidly fixed to the inner surface of said outer shell in a predetermined spaced relationship determined by the shape and size of said panels, a fitting defining a seat mounted on each stud, each fitting being capable of axial movement on its respective stud, locking means for locking the fitting in an adjusted position on the stud, each edge of each panel defining an extended lip portion adjacent the outer face thereof, said panels being supported in edge to edge relationship with said lip portions thereof located on the seats defined by said fittings, the latter being individually adjusted to provide a level supporting surface for the panels spaced from said outer shell, first elongated sealing means located within the spaces defined between the edges of adjacent panels and bridging the lip portions of the respective edges to seal the outer faces of said panels, filling means filling said spaces, and second elongated sealing means bridging the inner faces of adjacent panels to seal said spaces.

Preferably, the upstanding studs are threaded and the fitting comprises a sleeve with a mating thread in the bore thereof, an external flange being provided on the sleeve to provide said seat.

Conveniently, said first sealing means comprise lengths or beams of hardwood or other appropriate material defining longitudinally spaced appertures for location over respective lines or studs, and said locking means comprises lock nuts threaded onto the outer face of each sleeve for exerting pressure onto said lengths and thereby pressing the respective lip portions against their seats.

The panels are preferably constructed with a frame of a load-bearing insulation material not significantly affected dimentionally by extreme changes in temperature, e.g. balsa wood, with outer and inner faces of sheet insulation material e.g. Douglas fir plywood, the space defined within each panel being filled with a suitable relatively cheap insulation material (e.g. foam plastics or glass wool).

Conveniently, said lip portions of each panel are provided by the outer panel face being of larger dimensions than its frame.

The invention thus provides an arrangement for the thermal insulation panels in which the individual panels may be of identical construction and can be readily fitted and sealed together throughout so as to be capable of acting as a secondary barrier.

In order that the invention may be readily understood and further features made apparent an insulation system in accordance therewith for an L.N.G. tanker will now be described, by way of example, with reference to the accompanying drawings in which.

Figure 1:
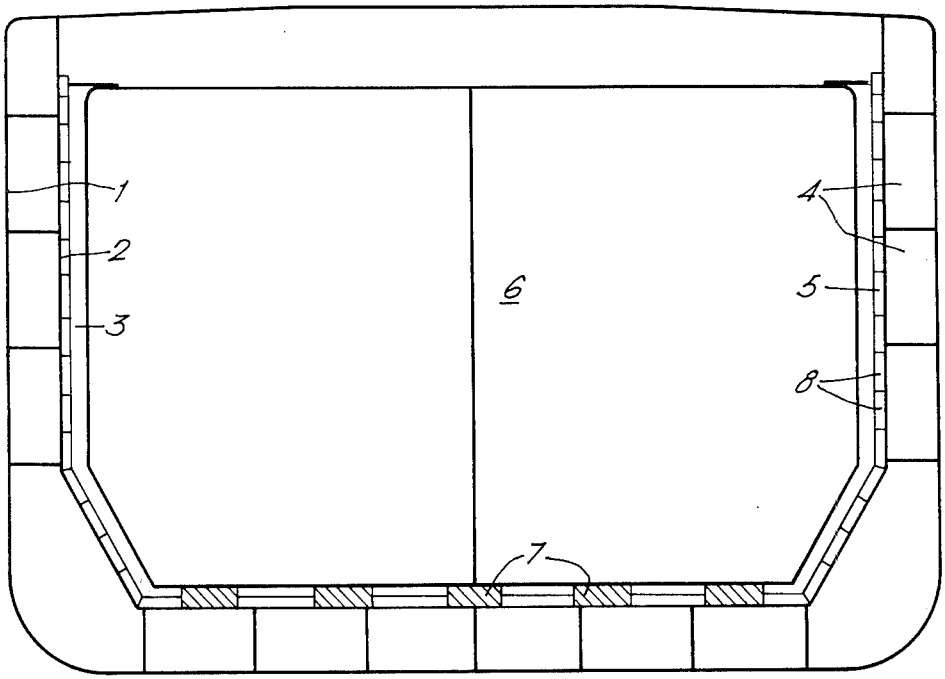
FIG. 1 is a diagrammatic transverse section through the tanker.

Referring to FIG. 1, as is well known in the art, the L.N.G. Tanker comprises outer and inner hulls 1, 2 respectively, and the inner hull is divided into a number of cargo holds 3 by transverse double bulkheads, or cofferdams (not shown). The spaces between the hulls and the bulkheads forming each cofferdam are divided into a number of closed compartments 4 for use as ballast tanks. Each cargo hold 3 is lined with the thermal insulation system 5 and houses a generally prismatic cargo-tank 6. In this embodiment, the tank 6 is of the self-supporting type, and rests on and is supported by load-bearing the areas 7 of the bottom layer of thermal insulation.

Figure 2:
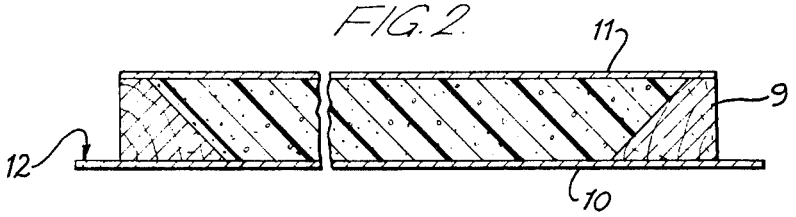
FIG. 2 is an enlarged sectional view of an insulation panel.

The thermal insulation is built up from a multiplicity of rectangular insulation panels 8 and, referring to FIG. 2, each panel is made up from an open frame 9 of balsa wood, which is faced with plywood sheets 10, 11. The outer face 10 is of larger dimentions than its frame 9 to provide a lip portion 12 completely around the panel. The materials (viz. balsa and plywood) for the panels are of such quality as not to be significantly affected dimentionally by extremes of temperature. The space left within each panel may then be filled with a cheaper insulation material, such as glass fibre or foam plastics. Said spaces may also be strengthened by the use of a core of honeycombe paper, for example, that known generally under the trade name "Kraft". In a preferred arrangement said spaces are filled by spraying therein polyurethane foam, the foam being bonded to the inner surfaces of the plywood faces and frame. Thus, although this foam has a significant co-efficient of expansion and will therefore change dimentionally with changing temperature, nevertheless it will retain its insulating effect by reason of it being bonded within the stable frame and facings 10, 11 of its panel. To ensure adequate bonding between the foam and the inner faces of the balsa frame 9, said inner faces are slanted as shown in FIG. 2.

Figure 3:
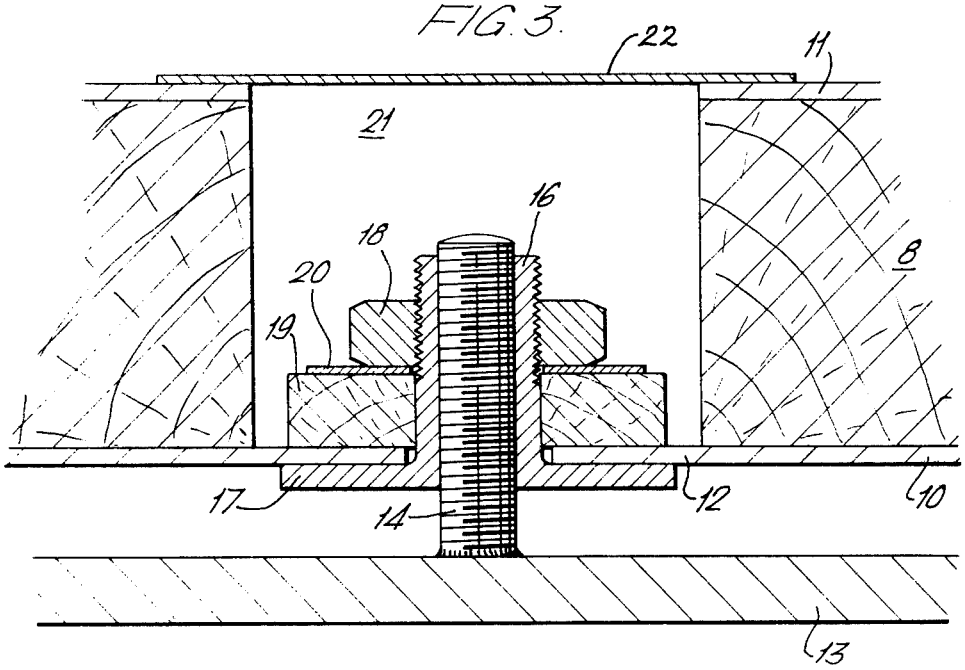
FIG. 3 is a further enlarged fragmentary vertical section through a joint between adjacent insulation panels.
Figure 4:
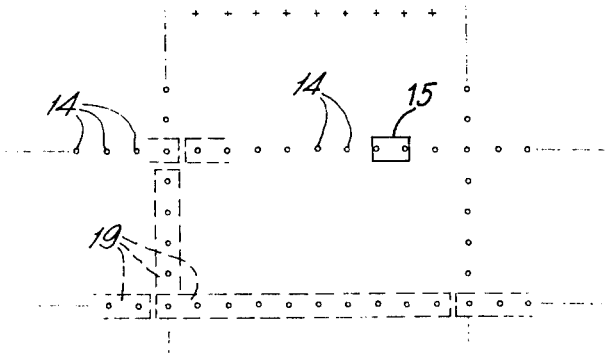
FIG. 4 is a fragmentary plan view of part of the wall of the cargo hold.

Referring to FIGS. 3 and 4, the side walls 13 of the cargo hold 3 have welded thereto a multiplicity of upstanding studs 14. These studs are arranged in a predetermined pattern depending upon the size and particular shape of the panels 8. In FIG. 4, it can be seen that the studs 14 are arranged in lines and in a rectangular lattice pattern, the rectangular spaces 15 defined between the stud lines being of slightly larger dimension than the oversize facings 10 of the panels 8. Referring particularly to FIG. 3, each stud 14 carries a sleeve 16 having a circular flange 17 at one end thereof. The stud and sleeve bore are provided with mating threads; the sleeve 16 may thus be rotated and thereby adjusted axially along its stud 14. The outer surface of each stud 14 is also threaded so as to receive a locknut 18. To mount the panels in position on the cargo hold walls 13, each panel 8 is located within a rectangular space 15 such that its lip portions 12 are seated on respective flanges 17, said sleeves are adjusted either before or during panel mounting as convenient to provide a level support surface spaced from the cargo hold walls 13 for the outer facings 12 of the panels. It will be appreciated that, in their located position, there is a gap between co-operating edges of the lip portions 12, due to the presence of the sleeves 16. The gap can be reduced if desired by extending the lip portions 12 and providing part-circular recesses along these edges at spacings corresponding to the spacing of the studs 14. In either case, adjacent panels 8 are secured and sealed together by sealing means in the form of beams 19 of hardwood, the beams being pressed down onto the co-operating lip portions 12 to force the latter against their seating flanges 17; the pressure of the beam is provided by appropriate tightening of the lock-nuts 18, via washers 20, and the joint is preferably further secured by the use of a suitable adhesive, such as epoxy resin, between the lip portions 12 and beams 19. A typical arrangement of the beams 19 is shown in chain-dotted lines in FIG. 4. The spaces 21 (see FIG. 3) left between the main edge portions of the panels 8 are then filled with further polyurethane foam sprayed in situ so as to bond onto said edges and a scab joint 22, preferably made of epoxy resin glass cloth, is extended over the space and adhered to the inner facings 11 of adjacent panels to effect final sealing.

Figure 5:
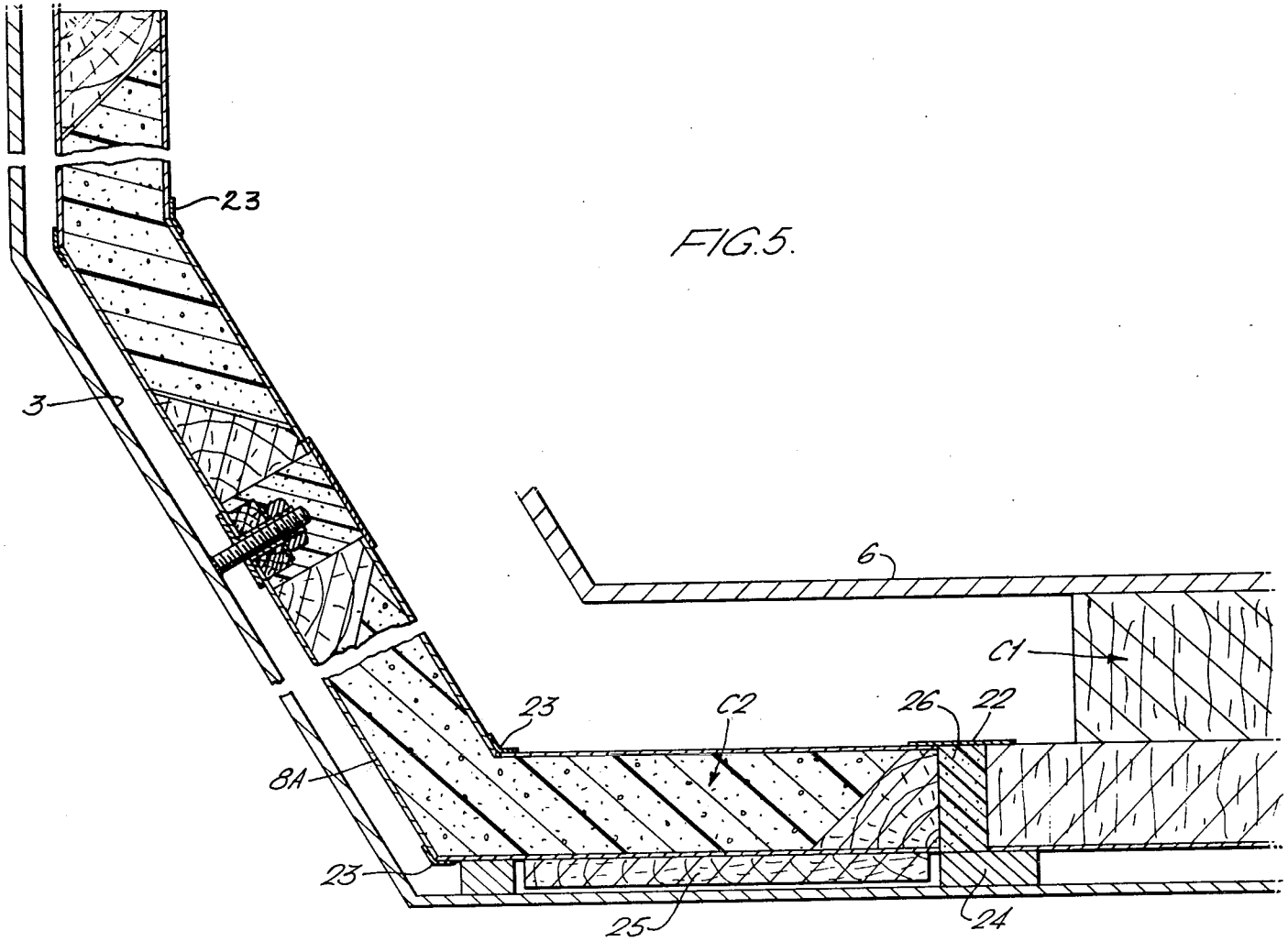
FIG. 5 is an enlarged section, similar to FIG. 1, through a bottom corner of the insulation system.

The insulation panels 8 discussed hereinbefore may also be utilised for the bottom wall of the cargo tank support insulation panel arrangement described in U.S. Pat. No. 3,830,396. Thus, in said U.S. Pat. No. 3,830,396, the bottom insulation comprises areas or "islands" referenced "C1" of load bearing insulation, on which the cargo tank is supported, whilst intermediate areas referenced "C2" are provided by polyurethane foam sprayed in situ and bonded to slanted edge faces provided around the "load-bearing islands". Referring to FIG. 5 of the accompanying drawings, the "C2" insulation is replaced with insulation panels 8 generally as described hereinbefore, said panels where they are to be located at a corner of the cargo hold 3 being similarly shaped as shown at 8A, the angular corners of the panels facings being strengthened by glass cloth coving strips 23. Where an edge of an insulation panel is to be located adjacent the edge of the "C1" insulation use is made of the timber grounds 24 normally provided, as shown in FIG. 5; also a balsa pad 25 may be provided on the outer facings 10 of the panels as shown, and the spaces left between the bottom wall of the cargo hold 3, the grounds 24 and the balsa pads 25 may be filled with mastic somewhat as described in said earlier U.S. Specification, to ensure a rigid sealing of the whole of the bottom layer of insulation. It will also be seen from FIG. 5 that the edges of the "C1" insulation are not slanted, as in the case of the arrangement in said earlier U.S. Pat. No. 3,830,396, and the spaces 26 between these edges and those of adjacent insulation panels are filled in a similar manner to the spaces 21 discussed above and covered by scab joints 22.

We claim:

1. (A). In a container for the bulk storage and transport of liquids at temperatures greatly differing from ambient temperature, comprising a storage tank adapted to hold a quantity of liquid, said tank surrounded and supported at least from below by thermal insulation which is (i) built up from a multiplicity of panels, (ii) sealed together and (iii) supported by a rigid outer shell, and means for providing a substantially level supporting surface for said panels spaced from said rigid outer shell, the improvement wherein said means for providing essentially comprises, (in place of wooden ground strips normally employed for such purpose):

a. upstanding studs rigidly fixed to the inner surface of said outer shell in a predetermined spaced relationship determined by the shape and size of said panels;

b. a fitting defining a seat mounted on each said stud, each fitting being capable of axial movement on its respective stud, said fitting comprising a sleeve defining a threaded bore for mating with a screw thread provided on said stud, and an external flange constituting said seat, axial adjustment of each sleeve being effected by appropriate rotation on its respective stud;

c. locking means for locking each said fitting in an adjusted position on its respective stud;

d. each edge of each panel defining an extended lip portion adjacent the outer face thereof;

e. said panels being supported in edge to edge relationship with said lip portion thereof located on said seats defined by said fittings, the latter being individually adjusted to provide a level supporting surface for said panels spaced from said outer shell;

f. first elongated sealing means located within the spaces defined between the edges of adjacent panels and bridging said lip portions of said respective edges to seal said outer faces of said panels;

g. filling means filling said spaces; and h. second elongated sealing means bridging the inner faces of adjacent panels to seal said spaces.

2. In a container as claimed in claim 1, wherein said first sealing means comprise beams defining longitudinally spaced apertures for fitting over respective lines of said studs to locate on said lip portions of said panels.

3. In a container as claimed in claim 2, wherein said locking means comprise lock nuts threaded onto said studs for tightening down onto said beams, thereby to press said lip portions onto their respective seats.

4. In a container as claimed in claim 1, wherein each said panel comprises (i) a frame of a load-bearing insulation material, (ii) faced with sheet insulation.

5. In a container as claimed in claim 1, wherein each said panel comprises (i) a frame of a load-bearing insulation material, (ii) facings of sheet insulation material not significantly affected dimensionally be extreme changes in temperature, and (iii) a filling of relatively cheap insulation material within the space defined by said frame and facings.

6. In a container as claimed in claim 5, wherein said frame comprises sprayed foam plastic bonded to the internal surfaces of said frame and facings.

7. In a container as claimed in claim 1, and adapted for the bulk storage and transport of liquified natural gas.

8. In a container as claimed in claim 7, mounted with a plurality of like containers, in an ocean-going marine tanker.

* * * * *

UNITED STATES PATENT OFFICE
CERTIFICATE OF CORRECTION

PATENT NO. : 4066184
DATED : January 3, 1978
INVENTOR(S) : William Livingstone Cuthbert and Thomas Brown It is certified that error appears in the above-identified patent and that said Letters Patent are hereby corrected as shown below:

Column 4, line 43: The term "(A)." should be cancelled.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*